US011391272B2

(12) United States Patent
Hines et al.

(10) Patent No.: US 11,391,272 B2
(45) Date of Patent: Jul. 19, 2022

(54) MECHANICAL TUBULAR DIAPHRAGM PUMP HAVING A HOUSING WITH UPSTREAM AND DOWNSTREAM CHECK VALVES FIXED THERETO AT EITHER END OF A RESILIENT TUBE FORMING A FLUID PATHWAY WHEREIN THE TUBE IS DEPRESSED BY A DEPRESSOR CONFIGURED TO BE MOVED BY A MOTORIZED RECIPROCATING UNIT

(71) Applicant: Graco Minnesota Inc., Minneapolis, MN (US)

(72) Inventors: Bradley H. Hines, Andover, MN (US); Mark S. Emery, Minneapolis, MN (US); Adam K. Collins, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 93 days.

(21) Appl. No.: 16/308,933

(22) PCT Filed: Jun. 12, 2017

(86) PCT No.: PCT/US2017/037028
§ 371 (c)(1),
(2) Date: Dec. 11, 2018

(87) PCT Pub. No.: WO2017/218420
PCT Pub. Date: Dec. 21, 2017

(65) Prior Publication Data

US 2020/0309109 A1 Oct. 1, 2020

Related U.S. Application Data

(60) Provisional application No. 62/349,304, filed on Jun. 13, 2016.

(51) Int. Cl.
*F04B 43/00* (2006.01)
*F04B 43/10* (2006.01)

(52) U.S. Cl.
CPC ..... *F04B 43/0072* (2013.01); *F04B 43/10* (2013.01); *F04B 2201/0201* (2013.01); *F04B 2201/0206* (2013.01)

(58) Field of Classification Search
CPC ..... F04B 43/0072; F04B 43/10; F04B 2201/0201; F04B 2201/0206
(Continued)

(56) References Cited

U.S. PATENT DOCUMENTS 28,758 A * 6/1860 Lanham ..... F04B 43/08 417/478
224,370 A * 2/1880 Wilson ..... F04B 43/08 417/478
(Continued)

FOREIGN PATENT DOCUMENTS

EP 2378121 A1 10/2011
WO 98/31935 A1 7/1998

OTHER PUBLICATIONS

International Preliminary Report on Patentability (Chapter 1 of the Patent Cooperation Treaty) on PCT/US2017/037028 dated Dec. 27, 2018.

*Primary Examiner* — Kenneth J Hansen
*Assistant Examiner* — Benjamin Doyle

(57) ABSTRACT

Mechanical tubular diaphragm pump features are presented herein. Such a tubular pump can include a resilient tube having a lumen and a pair of upstream and downstream check valves located along the same fluid pathway as the lumen. The tubular pump further includes a motorized reciprocating unit and a depressor configured to be moved by the motorized reciprocating unit to cyclically depress and release the resilient tube. The resilient tube forces fluid
(Continued)

within the lumen downstream past the downstream check valve as the resilient tube is depressed by the depressor, and further pulls upstream fluid past the upstream check valve and into the lumen as the resilient tube returns upon release by the depressor. Multiple resilient tubes may be used in the same pump. The tube(s), depressor, and valves may be attached to a housing that is modularly removable from the motorized reciprocating unit.

20 Claims, 7 Drawing Sheets

(58) Field of Classification Search
USPC ..... 417/475, 437, 474, 478
See application file for complete search history.

(56) References Cited

U.S. PATENT DOCUMENTS 247,142 A * 9/1881 Woods ..... F04B 43/08 417/478
493,208 A * 3/1893 Cruickshank ..... A61M 3/0262 604/36
2,527,614 A * 10/1950 Arpin ..... B05B 11/30 222/79
2,648,288 A * 8/1953 Marks ..... F04B 43/0063 417/478
2,961,965 A * 11/1960 Senning ..... G05D 9/04 417/211.5
3,046,903 A 7/1962 Jones
3,048,121 A 8/1962 Sheesley
3,127,845 A * 4/1964 Voelcker ..... F04B 43/08 417/478
3,175,498 A * 3/1965 Rohrer ..... F04B 43/1133 417/474
3,218,979 A * 11/1965 Baldwin ..... F04B 49/12 623/3.23
3,318,251 A * 5/1967 Smith ..... F04B 43/086 417/339
3,349,716 A * 10/1967 Weber ..... F04B 43/08 417/478
3,551,076 A * 12/1970 Wilson ..... F04B 43/067 417/385
3,606,596 A * 9/1971 Edwards ..... A61M 5/142 417/479
3,637,330 A * 1/1972 Goeldner ..... F04B 1/00 417/389
3,701,618 A * 10/1972 Wall ..... B28B 3/20 425/192 R
3,859,011 A 1/1975 Hart
3,983,857 A * 10/1976 O'Connor ..... F02M 1/16 123/179.11
3,987,775 A * 10/1976 O'Connor ..... F02M 1/16 123/179.11
4,012,178 A * 3/1977 Puckett ..... F04B 9/02 417/478
4,014,318 A * 3/1977 Dockum ..... A61M 1/1053 600/16
4,178,133 A * 12/1979 Rawicki ..... F04B 43/107 277/320
4,290,346 A * 9/1981 Bujan ..... F04B 43/0054 417/478
4,360,327 A 11/1982 Ohara et al.
4,443,216 A * 4/1984 Chappell ..... A61M 5/142 604/67
4,474,540 A * 10/1984 Bonastia ..... F04B 43/107 417/388
4,580,952 A * 4/1986 Eberle ..... F04B 47/04 417/383
4,886,432 A * 12/1989 Kimberlin ..... F04B 43/10 417/478
4,967,940 A * 11/1990 Blette ..... B67D 7/0216 222/109
5,033,943 A * 7/1991 Durrum ..... F04B 43/08 417/478
5,131,816 A * 7/1992 Brown ..... A61M 5/142 417/2
5,158,437 A * 10/1992 Natwick ..... A61M 5/14228 417/479
5,316,452 A 5/1994 Bogen et al.
5,368,452 A * 11/1994 Johnson ..... F04B 43/0736 417/395
5,415,532 A * 5/1995 Loughnane ..... F04B 43/082 417/411
5,577,891 A * 11/1996 Loughnane ..... F04B 43/082 417/412
5,947,167 A * 9/1999 Bogen ..... B01L 3/0293 141/1
6,302,660 B1 * 10/2001 Kurita ..... F04B 43/0072 417/383
6,887,047 B2 * 5/2005 Grapes ..... F04B 43/107 417/384
7,651,010 B2 * 1/2010 Orzech ..... B67D 1/108 222/214
7,854,600 B2 * 12/2010 Ogawa ..... F04B 43/082 417/474
8,172,554 B2 * 5/2012 Yajima ..... F04B 43/084 417/383
8,403,654 B2 * 3/2013 Podesta ..... F04B 33/00 417/478
2003/0017066 A1 * 1/2003 Danby ..... A21B 7/00 417/474
2005/0261423 A1 * 11/2005 Funkhauser ..... C08F 2/22 524/800
2012/0036991 A1 * 2/2012 Roman ..... F01L 29/06 91/14

* cited by examiner

MECHANICAL TUBULAR DIAPHRAGM PUMP HAVING A HOUSING WITH UPSTREAM AND DOWNSTREAM CHECK VALVES FIXED THERETO AT EITHER END OF A RESILIENT TUBE FORMING A FLUID PATHWAY WHEREIN THE TUBE IS DEPRESSED BY A DEPRESSOR CONFIGURED TO BE MOVED BY A MOTORIZED RECIPROCATING UNIT

CROSS-REFERENCE TO RELATED APPLICATIONS

This application claims priority to U.S. Provisional Application No. 62/349,304 filed Jun. 13, 2016, entitled "MECHANICAL TUBULAR DIAPHRAGM PUMP", the disclosure of which is hereby incorporated by reference herein in its entirety.

BACKGROUND

Diaphragm pumps can be useful for pumping fluids and gasses, particularly where versatility and contamination control are of concern and/or to move otherwise difficult to pump fluids. Many conventional diaphragm pumps are large and intended for permanent installation. Moreover, many conventional diaphragm pumps are not easily reconfigurable or serviceable, the conventional diaphragm discs being difficult to access and replace. These limitations can restrict the number of practical applications for diaphragm pumps. There is a need for diaphragm pumps which are portable, reconfigurable, and serviceable while maintaining high performance.

SUMMARY

Several embodiments demonstrating mechanical tubular diaphragm pump features are presented herein. A first embodiment includes a tube cyclically depressed and released by mechanical reciprocation. A pair of check valves located along the same fluid pathway as the tube limits flow of fluid to an upstream-to-downstream direction. Depression of the tube forces fluid downstream from the tube while release of the tube draws in upstream fluid. Such a pump can utilize any feature or aspect, or combination of the same, disclosed herein.

A second embodiment includes a resilient tube having a lumen and a pair of upstream and downstream check valves located along the same fluid pathway as the lumen. The tubular pump further includes a motorized reciprocating unit and a depressor configured to be moved by the motorized reciprocating unit to cyclically depress and release the resilient tube. The resilient tube forces fluid within the lumen downstream past the downstream check valve as the resilient tube is depressed by the depressor, and further pulls upstream fluid past the upstream check valve and into the lumen as the resilient tube returns upon release by the depressor. Multiple resilient tubes may be used in the same pump. The tube(s), depressor, and valves may be attached to a housing that is modularly removable from the motorized reciprocating unit. Such a pump can utilize any feature or aspect, or combination of the same, disclosed herein.

The scope of this disclosure is not limited to this summary. Further inventive aspects are presented in the drawings and elsewhere in this specification and in the claims.

This disclosure makes use of multiple embodiments and examples to demonstrate various inventive aspects. The presentation of the featured embodiments and examples should be understood as demonstrating a number of open-ended combinable options and not restricted embodiments. Changes can be made in form and detail to the various embodiments and features without departing from the spirit and scope of the invention.

DETAILED DESCRIPTION

Pumps of the present disclosure can be used to pump various fluids, such as liquids or gasses, including fluids containing solid matter. The pumps of the present disclosure can be used, for example, in fluid transfer, metering, and spraying applications. Various pump embodiments according to the present disclosure can include at least one resilient tube and a pair of upstream and downstream check valves integrated in a housing. The pump operates by repeatedly compressing at least one resilient tube to cause the fluid to flow through the pump and further downstream. The flow of the fluid is managed by the pair of upstream and downstream check valves. When multiple tubes are used, the tubes can be arrayed in parallel with each other. The tube(s) can be circular in cross sectional profile and linearly extend along a longitudinal dimension. Each tube can be easily replaced when the tube is worn and/or when a clean tube is desired. These and other aspects are further discussed herein.

Figure 1:
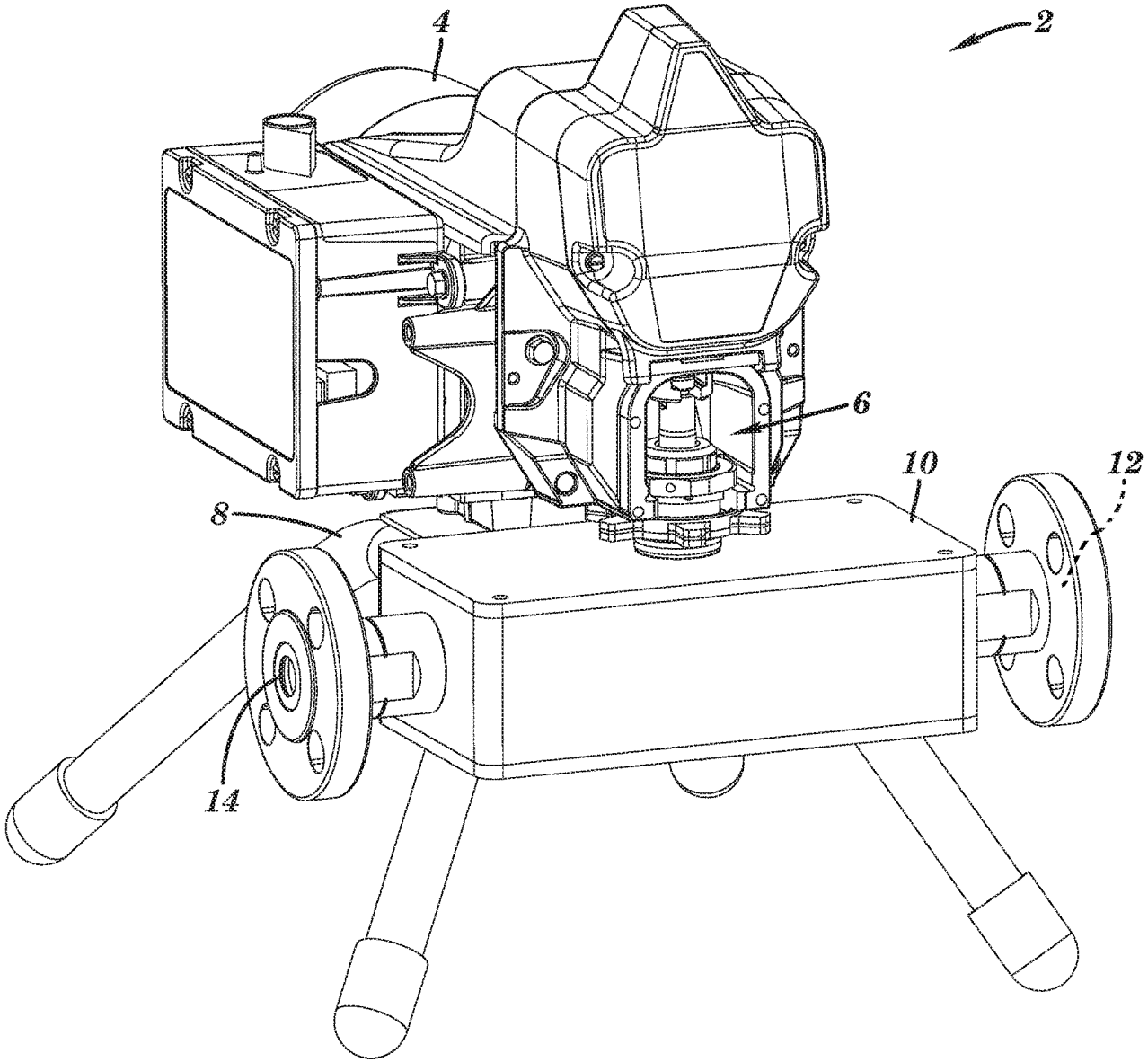
FIG. 1 is an isometric view of a tubular diaphragm pump system.

FIG. 1 is a perspective view of a fluid pump system 2. The fluid pump system 2 includes a motorized reciprocating unit 4. The motorized reciprocating unit 4 includes an electric, gas, pneumatic, or hydraulic powered motor, each of which is well known in the art. The particular motorized reciprocating unit 4 embodiment shown in FIG. 1 utilizes a conventional brushless direct current rotor stator, as is well known in the art, which outputs rotational motion. The motorized reciprocating unit 4 can further include a mechanism for converting rotational motion output from the motor into a linear reciprocating motion, as further discussed herein. The motorized reciprocating unit 4 is mounted on a frame 8. The frame 8 is shown in this embodiment as a tubular structure which supports the motorized reciprocating unit 4 and the rest of the fluid pump system 2. The frame 8 in this embodiment is shown to include legs for standing the motorized reciprocating unit 4 on the ground. The frame 8 can be formed from metal.

A modular pump 10 is mounted on the motorized reciprocating unit 4 by a pump coupling 6. The pump coupling 6 securely fixes the modular pump 10 to the motorized reciprocating unit 4 while also allowing reciprocating motion output from the motorized reciprocating unit 4 to be directed into the modular pump 10, as further discussed herein.

The modular pump 10 includes an inlet 12 through which fluid moves into the modular pump 10 and an outlet 14 through which the fluid moves out of the modular pump 10 under pressure. Pipes, tubes, manifolds, connectors, and the like, which are not illustrated but are known in the art, can be connected to the inlet 12 and the outlet 14 to manage fluid flow to and from the modular pump 10. For example, a first hose can supply fluid from a reservoir to the inlet 12 while a second hose can route fluid, under pressure, from the outlet 14 to a dispensing element, such as a nozzle, or as working fluid for actuation in another motor. The inlet 12 and outlet 14 are shown to include flanges to facilitate connection with hoses, however various embodiments may not include flanges.

The modular pump 10 may only be attached to the motorized reciprocating unit 4 via the pump coupling 6. In this way, the modular pump 10 may not be attached to the frame 8 or other structural element of the fluid pump system 2 except via the pump coupling 6. This single area of attachment between the modular pump 10 and the fluid pump system 2 facilitates modular removal of the modular pump 10 from the motorized reciprocating unit 4 as further discussed herein. A cover or door may be placed over the pump coupling 6 to cover moving components, however such a cover or door is not shown in FIG. 1.

Figure 2:
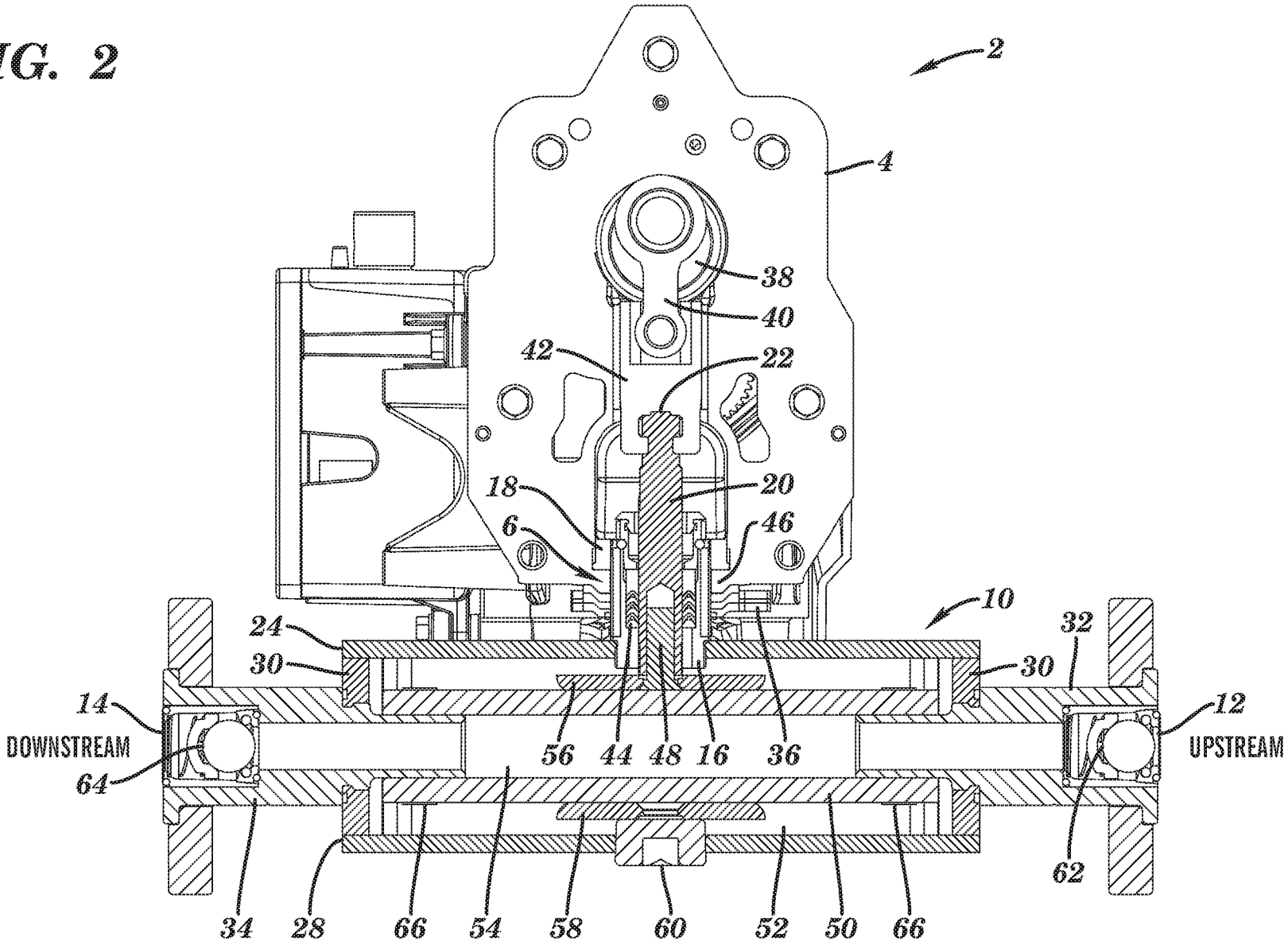
FIG. 2 is a cross sectional view of the tubular diaphragm pump system of FIG. 1.

FIG. 2 is a cross sectional view of the pumping system 2. As shown in FIG. 2, the modular pump 10 includes pump housing 24. The housing 24 fully encloses, and defines, a chamber 52 inside of which pump components are located. The pump housing 24 in this embodiment appears as a rectangular box, however different housing shapes are within the scope of this disclosure, such as square and tubular housings. The pump housing 24 can be formed from metal and/or polymer. The pump housing 24 includes a cover 26 on a top side and a bottom 28 on a bottom side. The pump housing 24 further includes four sidewalls 30 connecting the bottom 28 to the cover 26. The cover 26, bottom 28, and side walls 30 may be joined by fasteners (e.g., bolts) and/or welding, amongst other connecting options. Release of the fastener(s) allows the cover 26, a side wall 30, or the bottom 28 to be removed from the rest of the pump housing 24 (e.g., in the manner of a door) to allow access to the interior of the pump housing 24 for servicing.

The particular modular pump 10 shown includes a pump neck 16. The pump neck 16 is cylindrical. The pump neck 16 extends upwards from the pump housing 24. The pump neck 16 can be directly attached, or integral and continuous with, the pump housing 24, such as the cover 26. FIG. 2 shows that the modular pump 10 can include a rib 18 or other peripheral protrusion. The rib 18 is located around the pump neck 16. The rib 18 can be part of the pump neck 16 or otherwise be fixed with the pump neck 16. FIG. 2 shows that the modular pump 10 can include a retaining nut 36. The retaining nut 36 is located around the pump neck 16. The retaining nut 36 includes inner threading that engages outer threading on the pump neck 16. The retaining nut 36 can be moved up and down along the pump neck 16 by rotation of the retaining nut 36 relative to the pump neck 16 due to the threading.

The particular modular pump 10 shown includes a drive rod 20. The drive rod 20 includes a head 22 at its top. The head 22 facilitates attachment to the motorized reciprocating unit 4. The drive rod 20 moves within the pump neck 16 and protrudes out from the top of the pump neck 16 to expose the head 22. The pump neck 16 may brace the pump housing 24 relative to the motorized reciprocating unit 4 while the motorized reciprocating unit 4 moves the drive rod 20 relative to the pump neck 16 and the pump housing 24. One or more annular guides 44 surround a portion of the drive rod 20. The annular guides 44 can guide the drive rod 20 along a linear reciprocal path. The annular guides 44 can also seal the inside of the modular pump 10 about the reciprocating drive rod 20 to prevent escape of gas or fluid along the drive rod 20 toward the mechanics of the motorized reciprocating unit 4. Various embodiments may not include annular guide 44. The annular guides 44 can be formed from polymer, for example.

The view of FIG. 2 shows the modular pump 10, pump coupling 6, and motorized reciprocating unit 4 of the fluid pump system 2. The motorized reciprocating unit 4 generates rotational motion, as previously described, which is converted by a drive mechanism into linear reciprocal motion. The drive mechanism includes eccentric 38 and connecting arm 40 connected as a crank mechanism. The eccentric 38 is turned by a motor onboard the motorized reciprocating unit 4 behind the eccentric 38. The top of the connecting arm 40 is connected to the eccentric 38 while the bottom of the connecting arm 40 is attached to the collar 42. Rotation of the eccentric 38 moves the connecting arm 40 which in turn moves the collar 42 in an up-and-down linear reciprocating manner. As an alternative drive mechanism, a scotch yoke could convert rotation motion of the eccentric 38 into linear reciprocating motion of the collar 42. The head 22 of the drive rod 20 is cradled in the slot of the collar 42 to couple the movement of the drive rod 20 with that of the collar 42. The head 22, and the rest of the drive rod 20, moves up and down in a linear reciprocating manner with the movement of the collar 42.

As shown in FIGS. 1 and 2, the neck 16 of the modular pump 10 fits within a recess of the pump coupling 6 when the modular pump 10 is mounted on the motorized reciprocating unit 4. In the illustrated embodiment, the motorized reciprocating unit 4 includes a shelf 46. The shelf 46 can be formed from metal and can be rigidly attached to the frame 8 and/or main structure of the motorized reciprocating unit 4. The modular pump 10 clamps onto the shelf 46 to rigidly mount the modular pump 10 to the motorized reciprocating unit 4. The rib 18 sits above, and rests on, the shelf 46 with the neck 16 extending below the shelf 46. The nut 36 can be moved upwards by rotation to tighten against the bottom of the shelf 46 to clamp the shelf 46 between the nut 36 and the rib 18 to secure the modular pump 10 to the motorized reciprocating unit 4. Such fixation prevents movement of the pump neck 16 (and the rest of the pump housing 24 and the mounts 32, 34) relative to the drive rod 20 when the drive rod 20 is reciprocated by the motorized reciprocating unit 4.

The interface between the rib 18, shelf 46, and nut 36 (or other type of mount connection) forms a static connection. When the static connection is made, the pump neck 16, as well as the rest of the housing 24 and the mounts 32, 34 of the modular pump 10, will not move relative to the motorized reciprocating unit 4, despite the collar 42 moving the drive rod 20 of the modular pump 10. The interface of the drive rod 20 with the collar 42 forms a dynamic connection whereby the drive rod 20 and the collar 42 move together.

The modular pump 10 may be loosened by moving the nut 36 downwards by rotation to back the nut 36 off of the bottom of the shelf 46. Once loosened, the modular pump 10 can be dismounted from the motorized reciprocating unit 4 by sliding the modular pump 10 forward, in a single motion, away from the motorized reciprocating unit 4. The sliding motion removes the pump neck 16 from the motorized reciprocating unit 4 and also removes the head 22 of the drive rod 20 from the slot of the collar 42. This single sliding motion simultaneously disengages both the static and dynamic connections, assuming any clamps are loosened. It is noted that the illustrated mechanical components forming the pump coupling 6 demonstrate one example of mechanical components which can form static and dynamic mechanical connections which are easily breakable, and that different components having the same function are within the scope of this disclosure.

The dismounting of the modular pump 10 allows the modular pump 10 to be cleaned and serviced. Alternatively, the modular pump 10 can be removed for replacement by a newer, cleaner, or alternatively configured modular pump 10 (e.g., a larger, smaller, or adapted for different fluids, pressures, viscosities, and/or chemical resistances).

After servicing and/or modification, the modular pump 10 (or a different modular pump) can be remounted on the motorized reciprocating unit 4. The modular pump 10 is slid in a single linear motion to simultaneously engage (or reengage) the static and dynamic connections. The modular pump 10 is slid so that the rib 18 is above the shelf 46 and the nut 36 is below the shelf 46. Simultaneously, the head 22 is slid into the slot of the collar 42. After sliding, the nut 36 is moved upward and tightened against the shelf 46 to secure the modular pump 10 to the motorized reciprocating unit 4.

Figure 3:
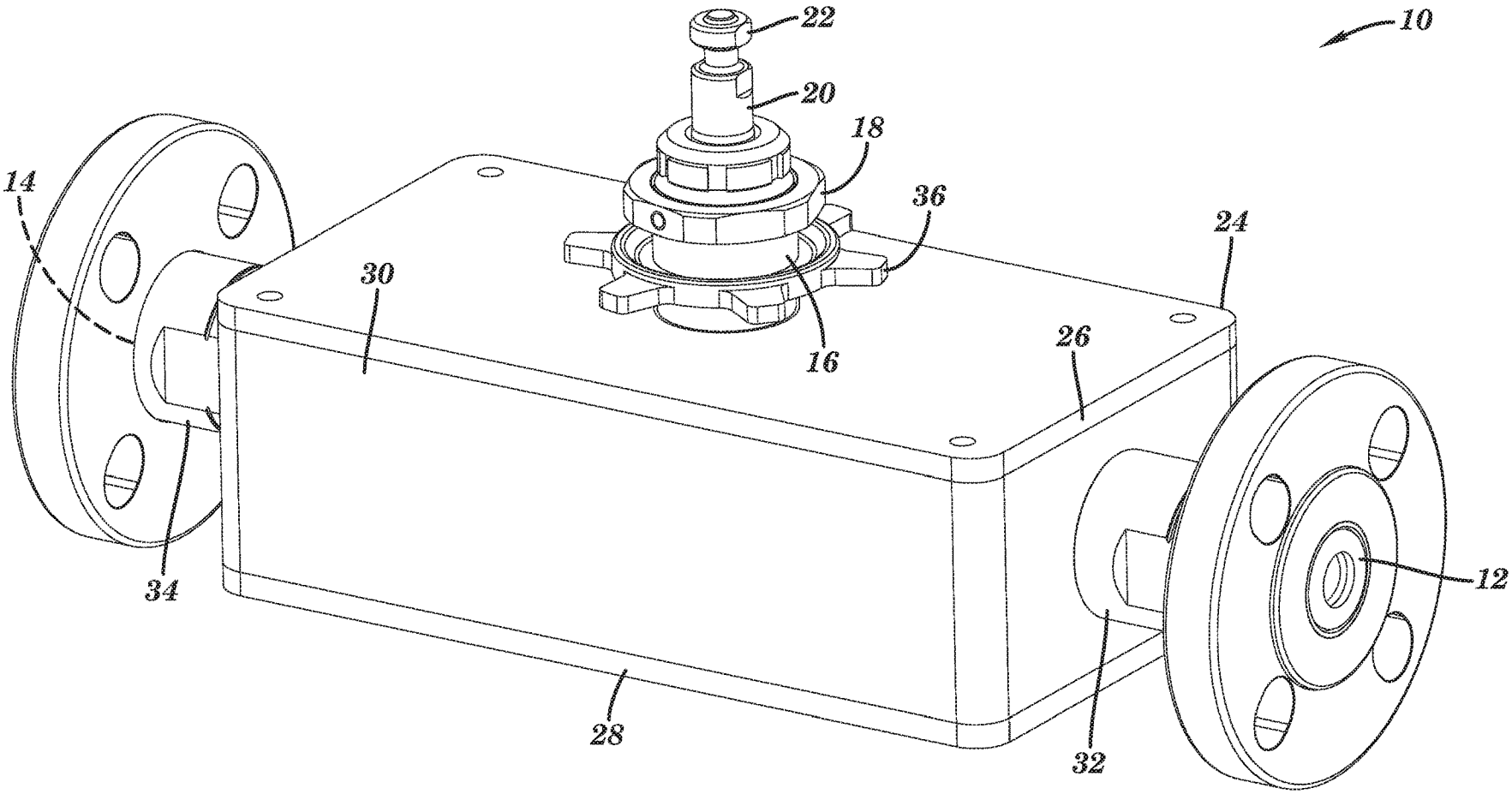
FIG. 3 is an isometric view of the modular pump of the system of FIG. 1.
Figure 4:
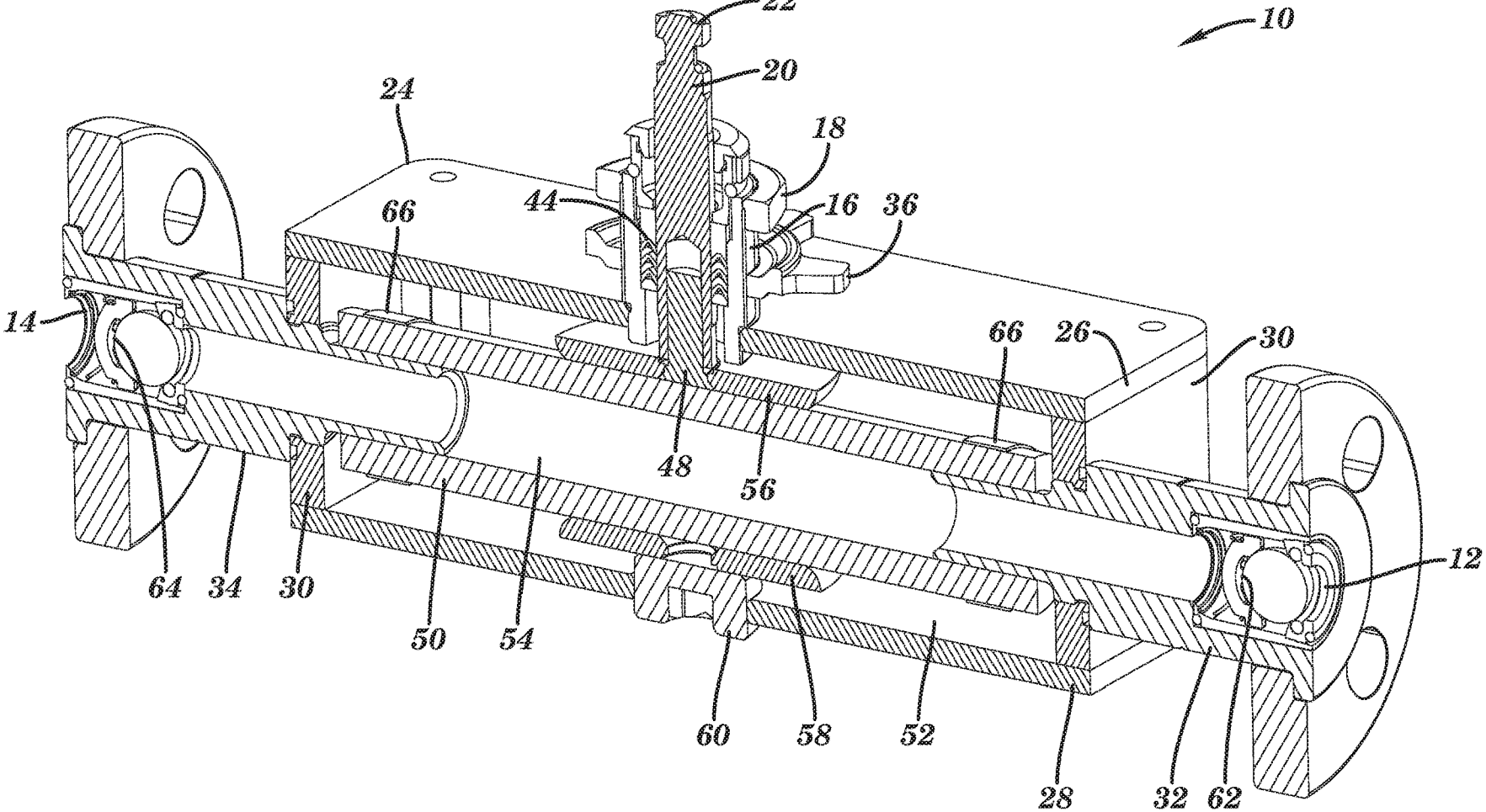
FIG. 4 is a sectional view of the modular pump of the system of FIG. 1.
Figure 5:
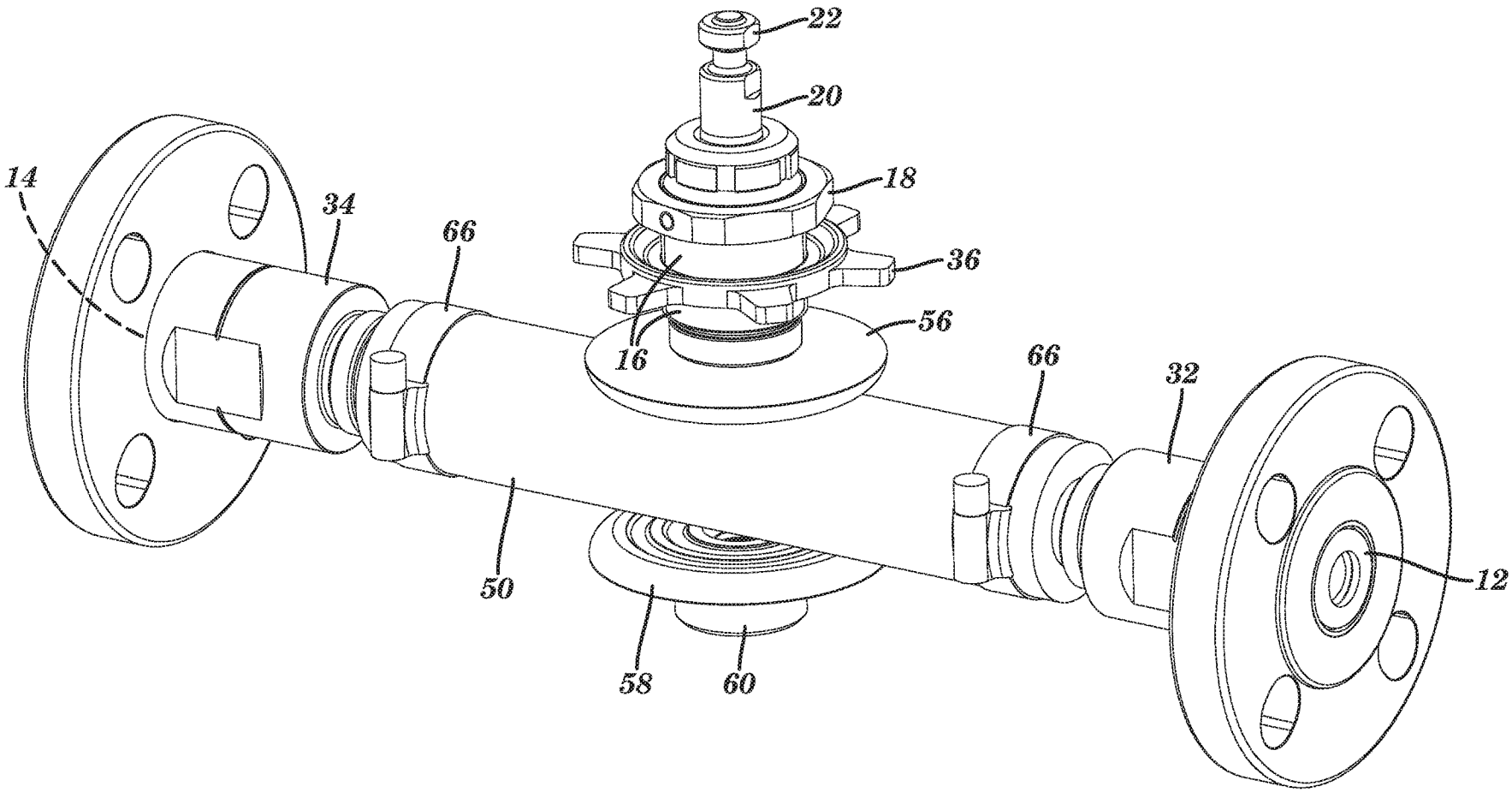
FIG. 5 is an isometric view of a tube and associated compressing components of the modular pump of the system of FIG. 1.

The mechanics of the modular pump 10 will be further discussed herein in reference to FIGS. 2-5. FIG. 3 is an isometric view of the modular pump 10 in isolation. In this view, the modular pump 10 has been removed from the motorized reciprocating unit 4 by disengagement at the pump coupling 6 as previously described. FIG. 4 shows a sectional view of the modular pump 10. FIG. 5 shows the pump 10 without the pump housing 24.

Within the housing 24 is a chamber 52. The chamber 52 is typically filled with air and open to the atmosphere via one or more holes through the housing 24. Entirely within the chamber 52 of the housing 24 is a tube 50. The tube 50 has a lumen 54 and defines part of a fluid pathway that extends from the inlet port 12 to the outlet port 14. The tube 50 is mounted an upstream mount 32 and a downstream mount 34.

The tube 50 extends straight between the mounts 32, 34 without bending in a nominal (i.e. undepressed) state. In this way, the tube 50 has a straight profile. The tube 50 has a circular cross section in its nominal state. Specifically, along its length, the tube 50 has a circular inner diameter and outer diameter. While tube 50 has a circular cross sectional profile in its nominal state as shown, the tube 50 may take a different nominal shape, such as elliptical or square. The tube 50 is resilient such that the tube 50 resists deformation by mechanical compression (but still collapses), and after release of the mechanical compression the tube 50 intrinsically returns to its nominal shape due to the spring properties of the material forming the tube 50. The tube 50 can be formed from various polymers, such as PTFE, silicone, or rubber, amongst other options.

The tube 50 has opposite upstream and downstream ends mounted on ends of an upstream mount 32 and a downstream mount 34, respectively. In the embodiment shown, the downstream end of the upstream mount 32 includes a narrowed circular end over and around which the upstream end of the tube 50 fits to seal the upstream end of the tube 50 with the upstream mount 32. Also, the upstream end of the downstream mount 34 includes a narrowed circular end over and around which the downstream end of the tube 50 fits to seal the downstream end of the tube 50 with the downstream mount 34. In other words, respective ends of the mounts 32, 34 are received within opposite ends of the tube 50. Alternatively, the opposite ends of the tube 50 could be received in larger diameter ends of the mounts 32, 34. No fluid is leaked into the pump housing 24 from the tube 50 or elsewhere.

The modular pump 10 is shown to include an upstream mount 32 and a downstream mount 34. The upstream mount 32 defines the inlet port 12 and the downstream mount 34 defines the outlet port 14, however the ports 12, 14 may be defined by different structures in various alternative embodiments. The mounts 32, 34 can extend through apertures formed in opposite side walls 30. The mounts 32, 34 can be attached to the side walls 30. As shown, the mounts 32, 34 are attached to opposite sides of the side walls 30 and project from the housing 24 in opposite directions. One or both mounts 32, 34 may have exterior threading that interfaces with interior threading in the apertures of the side walls 30 through which the mounts 32, 34 extend. The threaded interface(s) can allow the position of the mounts 32, 34 (along a horizontal left-right axis) to be changed relative to the rest of the housing 24 by relative rotation resulting in moving further inward or outward from the chamber 52. Moreover, rotation of one or both of the mounts 32, 34 relative to the housing 24 changes the spacing between the inner, opposed ends on the mounts 32, 34 on which the ends of the tube 50 are mounted. Adjusting the spacing in this way can help appropriately position the tube 50 as well as accommodate shorter and longer tubes. The mounts 32, 34 may alternatively be welded to the side walls 30 and therefore fixed. In another embodiment, the mounts 32, 34 are formed from the same material as, and are contiguous with, the side walls 30. The mounts 32, 34 can be formed from metal and/or polymer.

Fastener bands 66 are wrapped around the ends of the tube 50, over the upstream and downstream mounts 32, 34, respectively, to secure the tube 50 and seal the interior of the tube 50 to create a no-loss fluid pathway between the inlet 12 and the outlet 14. A portion of the upstream end of the tube 50 is positioned over a portion of the upstream mount 32 and a band fastener 66 is located around the portion of the upstream end of the tube 50 to squeeze and seal the portion of the upstream end of the tube 50 against the portion of the upstream mount 32. A portion of the downstream end of the tube 50 is positioned over a portion of the downstream mount 34 and another band fastener 66 is located around the portion of the downstream end of the tube 50 to squeeze and seal the portion of the downstream end of the tube 50 against the portion of the downstream mount 34. The fastener bands 66 may be tightened or loosened, such as by a screw driver, the fastener bands 66 being loosened to allow remove of the ends of the tube 50 from over the inner, opposing ends of the upstream and downstream mounts 32, 34.

The flow of fluid through the lumen 54 of the tube 50 is managed by valves 62, 64 located upstream and downstream, respectively, about the tube 50. Valve 62 is a check valve which allows fluid to flow from inlet port 12 into the lumen 54 but not in the reverse direction. Valve 65 is also a check valve which allows fluid to flow from within the lumen 54 through the outlet port 14, but not in the reverse direction. Together, the valves 62, 64 manage flow only in an upstream-to-downstream direction, which in the orientation of the view of FIG. 2 is right-to-left from the inlet 12 to the outlet 14, by preventing retrograde downstream-to-upstream flow. In this manner, the fluid passes through the inlet valve 62, through the upstream mount 52, through the lumen 54 within the tube 50, through the downstream mount 53, and past the outlet valve 64.

In the illustrated embodiment, each of the valves 62, 64 includes (in order from right-to-left) a seat, a ball, a cage, and a spring. The spring keeps the ball against the seat unless the spring force is overcome from the upstream direction, in which case the valve opens to allow flow only in the downstream direction. The valves 62, 64 are shown as ball valves, although different types of check valves can be used instead, such as flapper and poppet valves.

The inlet valve 62 is housed within the upstream mount 32. Likewise, the outlet valve 64 is housed within the downstream mount 34. In some embodiments, the valves 62, 64 may not be housed in the mounts 32, 34, and instead can be in located within separate housings that respectively support the check valves along the same fluid pathway. The valves 62, 64 are shown as located outside of the interior of the housing 24. Further, the valves 62, 64 are accessible from the ends of the mounts 32, 34 for servicing without opening the housing 24 or otherwise disassembling other parts of the modular pump 10. Alternatively, the valves 62, 64 could be located within the housing 24. In some embodiments, the valves 62, 64 may be located within the respective upstream and downstream ends of the tube 50, the valves 62, 64 housed within the portions of the mounts 32, 34 that extend within the upstream and downstream ends of the tube 50.

As shown in FIGS. 2 and 4-5, a depressor 56, a tube 50, and a stop 58 are located within the chamber 52 of the housing 24. The depressor 56, the tube 50, and the stop 58 are entirely contained and located within the chamber 52 of the housing 24. The tube 50 is directly between (i.e. sandwiched by) the depressor 56 and the stop 58. Each of the depressor 56 and the stop 58 extend into the chamber 52 and are separate from the housing 24. For example, the depressor 56 is located below, and separated from, the cover 24. The stop 58 is located above, and separated from, the bottom 28.

The depressor 56 is fixed to the drive rod 20 by fastener 48, although the relative distance between the depressor 56 and the drive rod 20 can be adjusted (to a plurality of different relative positions) as further discussed herein. Being fixed to the drive rod 20, the depressor 56 is reciprocated along upstrokes and downstrokes with the drive rod 20 as the drive rod 20 is reciprocated by the motorized reciprocating unit 4. The stop 58 is mounted to the housing 24 and remains stationary during reciprocation of the depressor 56. The position of the stop 58 is also adjustable (e.g., upwards and downwards) to a plurality of different positions, as will be explained further herein.

The downward motion of the depressor 56 on the downstroke squeezes the tube 50 directly between the depressor 56 and the stop 58 to cause the tube 50 to partially collapse or in some manner change in dimension to reduce the volume within the lumen 54. Because the tube 50 is sealed with each of the mounts 32, 34, a decrease in the inner volume of the lumen 54 increases the pressure within the lumen 54 and forces fluid within the lumen 54 to flow downstream past the outlet valve 64 while the inlet valve 62 closes to resist the fluid within the lumen 54 from flowing in the upstream direction. When the downstroke of the depressor 56 is complete and the depressor 56 moves upwards in an upstroke, the resiliency of the tube 50 causes the tube 50 to form its original shape (e.g., the tubular shape depicted). The recovery of the tube 50 causes the lumen 54 to expand in volume, thereby lowering the pressure within the lumen 54. The outlet valve 64 closes in response to this reversal in flow to prevent downstream fluid from reentering the tube 50. Meanwhile, the suction effect of the recovery of the tube 50 opens the inlet valve 62 and pulls upstream fluid past the inlet valve 62 and into the lumen 60. The depressor 56 finishes the upstroke and begins the next downstroke, starting the reciprocation cycle over again as the tube 50 is depressed, the valves 62, 64 reverse their states, and the fluid drawn into the lumen 54 on the previous upstroke is expelled downstream on the downstroke. This reciprocation cycle can be performed at relatively high frequency, such as, for example, between 1 Hz. and 100 Hz, although other frequencies, lesser and greater, are possible.

It is noted that neither the depressor 56 nor other structure urges the tube 50 to spring back to its nominal shape. Rather, the resilient material properties of the tube 50 itself causes the tube 50 to reform its nominal shape upon release by the depressor 56. Therefore, it is the tube 50 retaking its nominal shape that expands the lumen 54 and draws upstream fluid past the valve 62 and into the lumen 54.

The depressor 56 can be formed from metal or polymer. The depressor 56 can be a plate. The depressor 56 can be a disc. The depressor 56 can be wider or narrower than what is shown in the illustrated embodiment to correspondingly increase or decrease the length of the tube 50 depressed as well as the volume of the lumen 54 that is changed in each reciprocation cycle. The depressor 56 is fixed to the drive rod 20 via fastener 48. In the illustrated embodiment, the fastener 48 is a threaded rod that extends through, and is attached to (e.g., via welding or threading), a central aperture within the depressor 56. The fastener 48 extends into, and threadedly engages with, a threaded hole on the bottom of the drive rod 20. The threading interface fixes the position of the depressor 56 with respect to the drive rod 20 during pumping but allows for adjustment in their relative positions during servicing.

The position of the depressor 56 can be changed relative to the position of the drive rod 20. For example, in the illustrated embodiment, the depressor 56 is threadedly attached to the drive rod 20 such that relative rotation moves the depressor 56 up or down (closer or farther away) from drive rod 20, depending on the direction of rotation. Other adjustable means of attachment between the depressor 56 and drive rod 20 are possible, such as indexing of overlapping holes through which a pin can be inserted. The depressor 56 can change its position relative to the drive rod 20 to change the locations of the depressor 56 at which it reaches the top of the upstroke and the bottom of the downstroke. Lowering or raising the location of the bottom of the downstroke increases or decreases, respectively, the depth of compression of the tube 50 during reciprocation cycles, thereby adjusting the change in volume of the lumen 54 in each reciprocation cycle. Greater depth of compression can result in pumping a greater volume, but typically with greater motor load.

It may be preferable to close or distance the relative vertical positions of the depressor 56 and the drive rod 20 so that the location of the depressor 56 at the top of the upstroke is high enough such that the depressor 56, for at least a brief moment during the reciprocation cycle, no longer applies a force on the tube 50 to allow the tube 50 to be fully released. However, it may also be preferable to adjust the relative positions of the depressor 56 and the drive rod 20 so that no large gap, or possibly not any gap, is formed between the tube 50 and the depressor 50 during the upstroke (or other part of the reciprocation cycle) so that the entire downstroke is used for compressing the tube 50 without any unnecessary travel to reengage the tube 50. Adjusting the relative positions of the depressor 56 and the drive rod 20 allows the user to adjust the degree to which the tube 50 is released on the upstroke. In some cases, the depressor 56 fully releases the tube 50 so that the tube 50 is allowed to spring back to its nominal shape. In some cases, the depressor 56 only moves upwards on the upstroke enough to partially releases the tube 50 so that the tube 50 is not allowed to spring back to its nominal shape, although the tube 50 is still released to expand to some degree relative to the shape of the tube 50 at the bottom of the downstroke.

The stop 58 can be formed from metal or polymer. The stop 58 can be a plate. The stop 58 can be a disc. In the illustrated embodiments, the depressor 56 and the stop 58 are coaxially aligned discs. The stop 58 can be wider or narrower than what is shown in the illustrated embodiment to correspondingly increase or decrease the length of tube 50 compressed as well as the volume of the lumen 54 that is changed in each reciprocation cycle. The stop 58 is attached to a support 60. The support 60 can be a rod having exterior threading that engages inner threading of the aperture of the pump housing 24 (e.g., in the bottom 28) through which the support 60 extends. Rotation of the support 60 (e.g., from outside the pump housing 24) changes the position of the stop 58 relative to the position the pump housing 24 and the tube 50 to control the depth of compression of the tube 50 during the reciprocation cycle as well as adjusting any preload on the tube 50. Other adjustable means of attachment between the stop 58 and support 60 are possible, such as indexing of overlapping holes through which a pin can be inserted.

The stop 58 can change its position relative to the support 60 to increase or decrease the depth of compression of the tube 50 during reciprocation cycles, thereby adjusting the change in volume of the lumen 54 per reciprocation cycle. For example, the stop 58 may be positioned to contact the tube 50 at all times but apply a reaction force on the tube 50 only when the depressor 56 is pushing on the tube 50. Such an arrangement does not preload the tube 50 and maximizes the change in volume in the lumen 54 during the reciprocation cycle. The stop 58 may be positioned to depress the tube 50 even when the depressor 56 is at the top of its upstroke, such that the tube 50 is preloaded. Such an arrangement may be useful to prevent travel of the tube 50 during or between reciprocation cycles. In another example, the stop 58 may be positioned to not contact the tube 50 except for when the depressor 56 is pushing the tube 50 toward the stop 58 (e.g., when the depressor 56 is on the downstroke). Such an arrangement may be useful to decrease the amount of volumetric change in the lumen 52 during the reciprocation cycle, prevent any distortion of the tube 50 except during a reciprocation cycle, and/or to ensure that the tube 50 is free to spring back to its nominal state between reciprocation cycles.

Utilizing one or both of the modular pump 10 dismounting feature and the housing 24 opening feature, the performance of the fluid pump system 2 may be changed just by changing the tube 50. The tube 50 can be replaced by removal of the fastener bands 66 (e.g., by loosening with a screw driver) and removing the upstream and downstream ends of the tube 50 from the inner, opposing ends of the mountings 32, 34. A new tube 50, possibly having different dimensions and/or material properties, can be remounted on the inner, opposing ends of the mountings 32, 34 and the fastener bands 66 tightened around the ends of the new tube 50. As an example, a first type of tube 50 made from a first type of material having particular properties and having a first set of dimensions (e.g., inner diameter and wall thickness) may be suited for a first fluid transfer project. After the first fluid transfer project is complete, the modular pump 10 can be dismounted and/or the housing opened 24 and the tube 50 replaced with a second type of tube 50 made from a second type of material having particular properties and having a second set of dimensions suited for a second fluid transfer project, the first and second types of materials and dimensions being different from one another. In this way, the mere replacement of the tube 50 allows the pumping performance characteristics of the fluid pump system 2 to be easily changed depending on the demands of the particular task, thereby expanding the versatility of the fluid pump system 2 by the mere substitution of tubes 50.

The view of FIGS. 2, 4-5 show a single tube being used, however more than one tube may be used at a time. FIGS. 6-9 demonstrate various multi-tube embodiments. The tube arrangements shown in FIGS. 6-9 can be implemented in the modular pump 10, with all of the tubes fitting within the housing 24, and further used with the motorized reciprocating unit 4 as in the pump system 2. The mounts 32, 34 can have multiple fluid pathways, such as in the manner of a manifold, as well as multiple check valves, as demonstrated in the following FIGS. The pump components of FIGS. 6-9 can replace the correspondingly numbered internal pump components of the previously illustrated embodiment.

Figure 6:
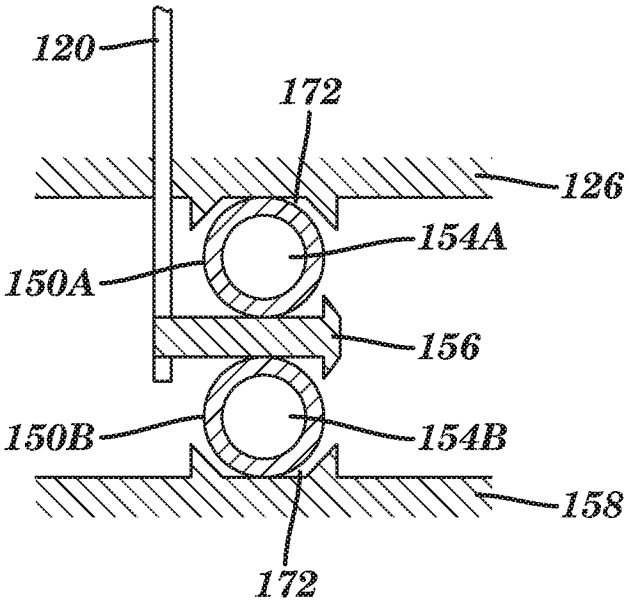
FIG. 6 is a cross sectional view of an over-under tubular diaphragm pump.

FIG. 6 shows a cross sectional view of tubes 150A-B in an over/under arrangement, the tubes 150A-B extending parallel with one another. It is noted that components sharing the first two digits of a reference numbers (e.g., 50, 150, 250; 56, 156, 256, etc.) of different embodiments can have similar configurations amongst the various illustrated and described embodiments, except for those aspects specifically shown or described to be different. For example, the drive rod 120 can be identical in form and/or function to drive rod 20, and can be used in a similar fluid pump system 2, except for those particular aspects shown or described to be different. For the sake of brevity, the description of common aspects (e.g., overall fluid pump system, materials, features, functions, properties, etc.) are not repeated for different components having similar reference numbers. For all referenced embodiments, an aspect described and/or shown for one embodiment can be implemented in another embodiment unless otherwise described or shown to be incompatible. In some cases, only the differences between the embodiments are described.

The pump of the embodiment of FIG. 6 includes a drive rod 120 connected to a depressor 156. The drive rod 120 is connected to a mechanism that, similar to the reciprocation mechanism of the previous embodiment (e.g., the motorized reciprocating unit 4), moves the drive rod 120 linearly up and down. The depressor 156 is attached to the drive rod 120 and moves up and down through up and down strokes with the drive rod 120. The depressor 156 is located directly between (i.e. sandwiched) tubes 150A-B, which are further located directly between cover 126 and stop 158. The cover 126 could instead be a stop. The stop 158 could instead be a bottom of a housing (such as bottom 28 of housing 24). In any case, the cover 126 and stop 158, or other surfaces which support the tubes 150A-B, do not move during pumping and instead brace the tubes 150A-B while the depressor 156 moves. The cover 126, stop 158, and depressor 156, and/or other tube contacting elements can be positionally adjustable in the same manner as the depressor 56 and stop 58 are positionally adjustable in the previous embodiment. The cover 126 and stop 158 form grooves 172 within which the tubes 150A-B reside to prevent the tubes 150A-B from moving laterally when compressed.

The pump of FIG. 6 is double acting in that, on the downstroke, tube 150B is compressed to force fluid from lumen 154A downstream while tube 150A is allowed to recover to pull upstream fluid into lumen 154B. This is reversed on the upstroke when the tube 150B is allowed to recover while tube 150A is compressed. This increases the output of the pump and reduces pressure and flow spikes in the fluid output by the pump as fluid is sucked in and expelled from the tubes 150A-B on each of the upstroke and downstroke. The embodiment of FIGS. 6-7 can be used in the fluid pump system 2, and the tubes 150A-B can replace the single tube 50 in the housing 24.

Figure 7:
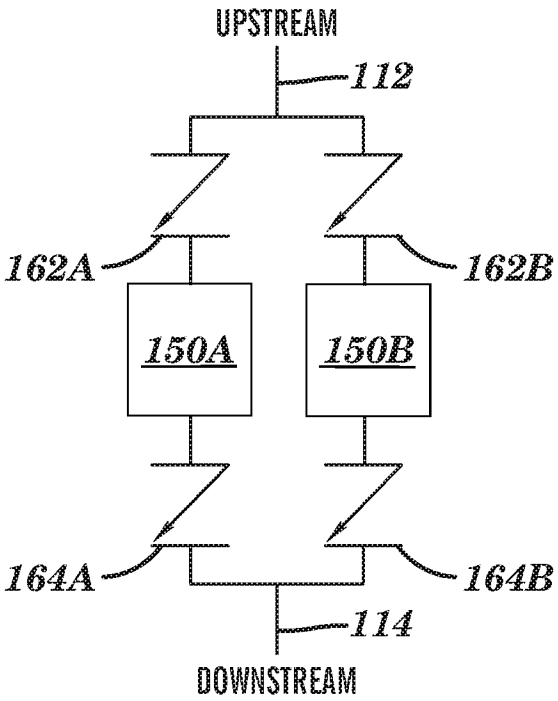
FIG. 7 is a schematic fluid circuit diagram of the over-under tubular diaphragm pump of FIG. 6.

FIG. 7 is a schematic flow diagram demonstrating an option for arranging the tubes 150A-B of the embodiment of FIG. 6 relative to check valves 162A-B, 164A-B. The check valves 162A-B, 164A-B may be similar to check valves 62, 64 in configuration and orientation and by being housed on the modular pump 10 (e.g., in mountings). For example, the check valves 162A-B, 164A-B only allow fluid to flow in an upstream-to-downstream direction as the tubes 150A-B are depressed and released.

FIG. 7 demonstrates that, after passing through the fluid inlet 112, the flow of fluid can be divided into two parallel flow paths (or some other number equal to the number of tubes used) before passing through a corresponding number of inlet valves 162A-B (or some other number equal to the number of tubes used), a corresponding number of tubes 150A-B, and a corresponding number of outlet valves 146A-B, and then being rejoined before passing through fluid output 114. As with the previous embodiment, the flow is between fluid inlet 112 and fluid output 114. As such, the inlet valves 162A-B, the tubes 150A-B, lumens 154A-B, and outlet valves 146A-B, are respectively located along parallel fluid pathways.

Figure 9:
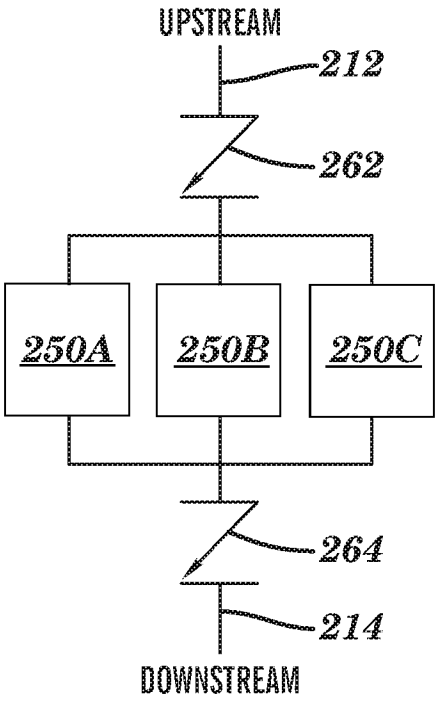
FIG. 9 is a schematic fluid circuit diagram of the side by side tubular diaphragm pump of FIG. 8.
Figure 8:
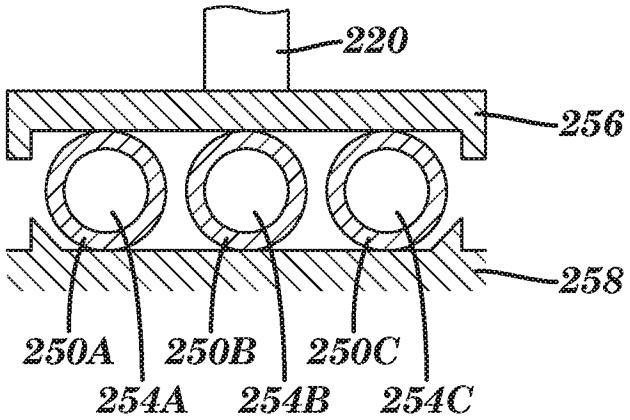
FIG. 8 is a cross sectional view of a side-by side tubular diaphragm pump.

FIG. 8 shows a cross sectional view of tubes 250A-C in a side-by-side arrangement, the tubes 250A-C extending parallel with each other. FIG. 9 is a schematic flow diagram demonstrating an option for arranging the tubes 250A-C of the embodiment of FIG. 8 relative to check valves 262A-C, 264A-C. The pump components of FIGS. 8-9 can replace the corresponding internal pump components of the previous embodiments. For example, the embodiment of FIGS. 8-9 can be used in the fluid pump system 2, and the tubes 250A-C can replace the single tube 50 in the housing 24. The embodiment of FIGS. 8-9 includes a drive rod 220 connected to a depressor 256. The drive rod 220 is connected to a mechanism that, similar to the reciprocation mechanism of the previous embodiments, moves the drive rod 220 linearly up and down respectively corresponding to up and down strokes.

Three tubes 250A-C are located directly between (i.e. sandwiched between) the depressor 256 and the stop 258. The stop 258 can be similar to the stop 58 of the first embodiment, such as by being adjustable by support 60. The stop 258 may alternatively be the bottom 28 of the housing 24. While three tubes are shown, any number of tubes can be used, such as 1, 2, 4, or a greater number. The tubes 250A-C are simultaneously depressed by the depressor 256 during the downstroke to expel fluid out of the lumens 254A-C and simultaneously released on the upstroke to recover and pull in more fluid through a fluid inlet 212 and into the lumens 254A-C. The embodiment of FIGS. 8-9 demonstrates, among other things, that a single depressor 256 can simultaneously squeeze multiple tubes to increase the fluid output of a pump and release multiple tubes to correspondingly increase fluid intake into the pump. A groove can be formed in either of both of the depressor 256 and the stop 258, the tubes 250A-C residing in the groove to prevent lateral movement of the tubes 250A-C during pumping.

FIG. 9 demonstrates that the flow of fluid can be divided between the three tubes 250A-C (or some other number of tubes) after passing through inlet valve 262 and rejoined before passing through outlet valve 264. Check valves 262, 264 may be similar to check valves 62, 64 in configuration and orientation and by being housed on the modular pump 10 (e.g., in mountings). For example, the check valves 262, 264 only allow fluid to flow in an upstream-to-downstream direction as the tubes 250A-C are depressed and released. The mounts on which the tubes 250A-C are mounted may be similar to the mounts 32, 34 except that the mountings of this embodiment divide the flow path upstream and then consolidate the flow paths downstream instead of having a single flow path as with the first embodiment. FIG. 9 demonstrates that, after passing through the fluid inlet 212, the flow of fluid can pass through inlet check valve 212 before being divided into three parallel flow paths (or some other number equal to the number of tubes used) through the tubes 250A-B. The fluid is pulled through the inlet 212 and inlet check valve 262 and then into each of the tubes 250A-B as the tubes 250A-C recover during decompression on the upstroke. The fluid is expelled from the tubes 250A-B as the tubes 250A-C are depressed by depressor 256 on the downstroke. Specifically, the fluid is expelled through outlet check valve 264 and outlet port 214.

Although "top" and "bottom", "up" and "down", "left" and "right", and "upstream" and "downstream" are used herein for convenience to correspond to the orientations shown, these and other embodiment need not have such orientation. For example, for parts having "top" (cover) and "bottom" designations herein, "first" and "second" designations can alternatively be used. Likewise, for parts having "upstream" and "downstream" designations herein, "first" and "second" designations can alternatively be used. The "downstroke" of a depressor (or other component) can be referred to as movement of a depressor in a first direction, while the "upstroke" of a depressor (or other component) can be referred to as movement of a depressor in a second direction opposite the first direction.

The present disclosure is made using different embodiments to highlight various inventive aspects. As such, the disclosure presents the inventive aspects in an exemplar fashion and not in a limiting fashion. Modifications can be made to the embodiments presented herein without departing from the scope of the invention. For example, a feature disclosed in connection with one embodiment can be integrated into a different embodiment. As such, the scope of the invention is not limited to the embodiments disclosed herein.

The following is claimed:

1. A tubular diaphragm pump for pumping fluid, the pump comprising:

a resilient tube having a lumen, the lumen part of a fluid pathway;

an upstream check valve and a downstream check valve located along the fluid pathway;

a motorized reciprocating unit; and a depressor configured to be moved by the motorized reciprocating unit in a linear reciprocating motion to cyclically depress and release the resilient tube, a housing comprising a top wall, a bottom wall, and a plurality of side walls that form a box that defines a chamber, the resilient tube and the depressor both contained within the chamber, the upstream and downstream check valves are fixed to the housing, the resilient tube spaced apart by an airgap from each of the top wall, the bottom wall, and each of the plurality of side walls;

a coupling, the coupling forming a static connection that mounts the housing to the motorized reciprocating unit, and a dynamic connection that mechanically connects the motorized reciprocating unit to the depressor so that the motorized reciprocating unit can reciprocally move the depressor, wherein the coupling is configured to allow the housing to be dismounted from the motorized reciprocating unit by disengaging the static connection and the dynamic connection, the upstream and downstream check valves being dismounted from the motorized reciprocating unit together with dismounting of the housing;

wherein the resilient tube is configured to:

force fluid within the lumen downstream past the downstream check valve as the resilient tube is depressed by the depressor, and pull upstream fluid past the upstream check valve and into the lumen as the resilient tube returns upon release by the depressor.

2. The pump of claim 1, further comprising a stop that is positioned opposite the depressor such that the resilient tube is squeezed directly between the depressor and the stop as the depressor depresses the resilient tube.

3. The pump of claim 2, wherein:

the position of the stop is adjustable, and changing the position of the stop changes the degree to which the resilient tube is compressed during each depression and release cycle.

4. The pump of claim 2, wherein the depressor is a plate and the stop is a plate.

5. The pump of claim 2, wherein the depressor and the stop are coaxially aligned discs.

6. The pump of claim 1, wherein the resilient tube has a straight profile when not depressed by the depressor.

7. The pump of claim 1, wherein the resilient tube is circular.

8. The pump of claim 1, further comprising an upstream mount and a downstream mount, wherein:

the resilient tube comprises an upstream end and a downstream end opposite the upstream end, the upstream end of the resilient tube is engaged with and sealed against the upstream mount, and the downstream end of the resilient tube is engaged with and sealed against the downstream mount.

9. The pump of claim 8, further comprising a first band fastener and a second band fastener, wherein:

a portion of the upstream end of the resilient tube is positioned over a portion of the upstream mount and the first band fastener is located around the portion of the upstream end of the resilient tube to squeeze and seal the portion of the upstream end of the resilient tube against the portion of the upstream mount, and a portion of the downstream end of the resilient tube is positioned over a portion of the downstream mount and the second band fastener is located around the portion of the downstream end of the resilient tube to squeeze and seal the portion of the downstream end of the resilient tube against the portion of the downstream mount.

10. The pump of claim 8, wherein the upstream check valve is located within the upstream mount and the downstream check valve is located within the downstream mount.

11. The pump of claim 1, wherein the upstream and downstream check valves each comprise a ball and seat valve.

12. A tubular diaphragm pump for pumping fluid, the pump comprising:

a resilient tube having a lumen, the lumen forming part of a fluid pathway;

an upstream check valve and a downstream check valve located along the fluid pathway;

a motorized reciprocating unit;

a depressor configured to be moved by the motorized reciprocating unit in a linear reciprocating motion to cyclically depress and release the resilient tube;

a housing, wherein the resilient tube and the depressor are both entirely contained within the housing, and the upstream and downstream check valves are fixed to the housing;

a coupling, the coupling comprising a neck that is attached to the housing and that extends outward from the housing, the neck configured to form a static connection by interfacing with the motorized reciprocating unit to fix the housing to the motorized reciprocating unit, the coupling further comprising a dynamic connection that mechanically connects the motorized reciprocating unit to the depressor so that the motorized reciprocating unit can reciprocally move the depressor relative to the housing, the coupling configured to allow the housing to be dismounted from the motorized reciprocating unit by disengaging the static connection and the dynamic connection, the upstream and downstream check valves being dismounted from the motorized reciprocating unit together with dismounting of the housing; and a drive rod having a head, the drive rod being longer than the neck such that the drive rod extends from inside of the housing, through the neck, and outwardly beyond the neck such that the head is located outside of the housing and the neck, the depressor connected to the drive rod so that the depressor reciprocates with the drive rod, the head forming the dynamic connection so that the motorized reciprocating unit reciprocates the depressor via the drive rod, the neck attached to the housing such that the neck with the drive rod extending through the neck are dismounted from the motorized reciprocating unit together with dismounting of the housing from the motorized reciprocating unit, wherein the resilient tube is configured to:

force fluid within the lumen downstream past the downstream check valve as the resilient tube is depressed by the depressor, and pull upstream fluid past the upstream check valve and into the lumen as the resilient tube returns upon release by the depressor.

13. A tubular diaphragm pump for pumping fluid, the pump comprising:

a resilient tube having a lumen, the lumen part of a fluid pathway;

an upstream check valve and a downstream check valve located along the fluid pathway;

a motorized reciprocating unit;

a depressor configured to be moved by the motorized reciprocating unit in a linear reciprocating motion to cyclically depress and release the resilient tube;

a housing, the depressor and the resilient tube both contained within the housing, the upstream and downstream check valves fixed to the housing;

a coupling, the coupling forming a static connection that mounts the housing to the motorized reciprocating unit and a dynamic connection that mechanically connects the motorized reciprocating unit to the depressor so that the motorized reciprocating unit can reciprocally move the depressor, wherein the coupling is configured to allow the housing to be dismounted from the motorized reciprocating unit by disengaging the static connection and the dynamic connection, the upstream and downstream check valves being dismounted from the motorized reciprocating unit together with dismounting of the housing; and a drive rod having a head, the drive rod extending from outside the housing to inside the housing, the depressor connected to the drive rod so that the depressor reciprocates with the drive rod, the head configured to attach to the motorized reciprocating unit to form the dynamic connection so that the motorized reciprocating unit reciprocates the depressor via the drive rod, the head configured to separate from the motorized reciprocating unit during dismounting of the housing from the motorized reciprocating unit, wherein the static connection and the dynamic connection are both simultaneously disengaged by a single sliding motion of the housing away from the motorized reciprocating unit to dismount the housing, both of the upstream check valve and the downstream check valve together with the housing moving away from the motorized reciprocating unit during the single sliding motion, wherein the resilient tube is configured to:

force fluid within the lumen downstream past the downstream check valve as the resilient tube is depressed by the depressor, and pull upstream fluid past the upstream check valve and into the lumen as the resilient tube returns upon release by the depressor.

14. The pump of claim 1, wherein the static connection and the dynamic connection are simultaneously disengaged by a single sliding motion of the housing away from the motorized reciprocating unit to dismount the housing.

15. The pump of claim 12, wherein the housing is a rectangular box.

16. The pump of claim 1, wherein:

the resilient tube is one of a pair of resilient tubes comprising a first resilient tube and a second resilient tube forming parallel fluid pathways, the first resilient tube is depressed while the second resilient tube is released from compression as the depressor moves in a first direction, the second resilient tube is depressed while the first resilient tube is released from compression as the depressor moves in a second direction opposite the first direction, and each resilient tube of the pair of tubes is configured to force fluid within its lumen downstream as the resilient tube is depressed and pull upstream fluid into its lumen as the resilient tube returns upon release by the depressor.

17. The pump of claim 1, wherein:

the resilient tube is one of a plurality of resilient tubes arrayed parallel with respect to each other, all of the plurality of resilient tubes are depressed simultaneously, all of the plurality of resilient tubes are released simultaneously, and each resilient tube of the plurality of tubes is configured to force fluid within its lumen downstream as the resilient tube is depressed and pull upstream fluid into its lumen as the resilient tube returns upon release, wherein the fluid that passes through the plurality of resilient tubes passes through both of the upstream check valve and the downstream check valve.

18. The pump of claim 8, wherein the resilient tube extends straight from the upstream mount to the downstream mount when the resilient tube is undepressed by the depressor.

19. The pump of claim 1, further comprising a drive rod having a head, the drive rod extending from outside the housing to inside the housing, the depressor connected to the drive rod so that the depressor reciprocates with the drive rod, the head configured to attach to the motorized reciprocating unit to form the dynamic connection so that the motorized reciprocating unit reciprocates the depressor via the drive rod, the head configured to separate from the motorized reciprocating unit during dismounting of the housing from the motorized reciprocating unit.

20. The pump of claim 1, wherein the motorized reciprocating unit comprises an eccentric that generates the linear reciprocating motion that reciprocates the depressor, the eccentric located outside the housing.

* * * * *